United States Patent [19]

Bowersett et al.

[11] Patent Number: 4,949,643

[45] Date of Patent: Aug. 21, 1990

[54] ANTI-TILT BUOY MOORING SYSTEM

[75] Inventors: Charles F. Bowersett, Burtonsville; Eugene H. Beach, Silver Spring, both of Md.

[73] Assignee: The United States of America as represented by the Secretary of the Navy, Washington, D.C.

[21] Appl. No.: 488,249

[22] Filed: Jul. 11, 1974

[51] Int. Cl.[5] ..... F42B 22/00

[52] U.S. Cl. ..... 102/413; 102/417

[58] Field of Search ..... 102/13; 9/8

[56] References Cited

U.S. PATENT DOCUMENTS 2,899,896 8/1959 Hobbs ..... 102/417

3,262,173 7/1966 Pickens ..... 102/413

3,648,611 3/1972 Noel ..... 102/413

*Primary Examiner*—David H. Brown

*Attorney, Agent, or Firm*—Kenneth E. Walden

[57] ABSTRACT

A buoy mooring device and system adapted to maintain a buoy in an upright or untilted position. A rigid bail having a center of curvature essentially coincident with the buoy center of buoyancy is connected to the bottom of the buoy. A mooring line having an anchor on one end is attached on the other end to the bail by a movable connecting means. As wind and/or water currents tend to tilt the buoy, the mooring system maintains the buoy in an upright position. Alternative embodiments include mooring systems comprising foldable bails and systems comprising multiple bails.

7 Claims, 1 Drawing Sheet

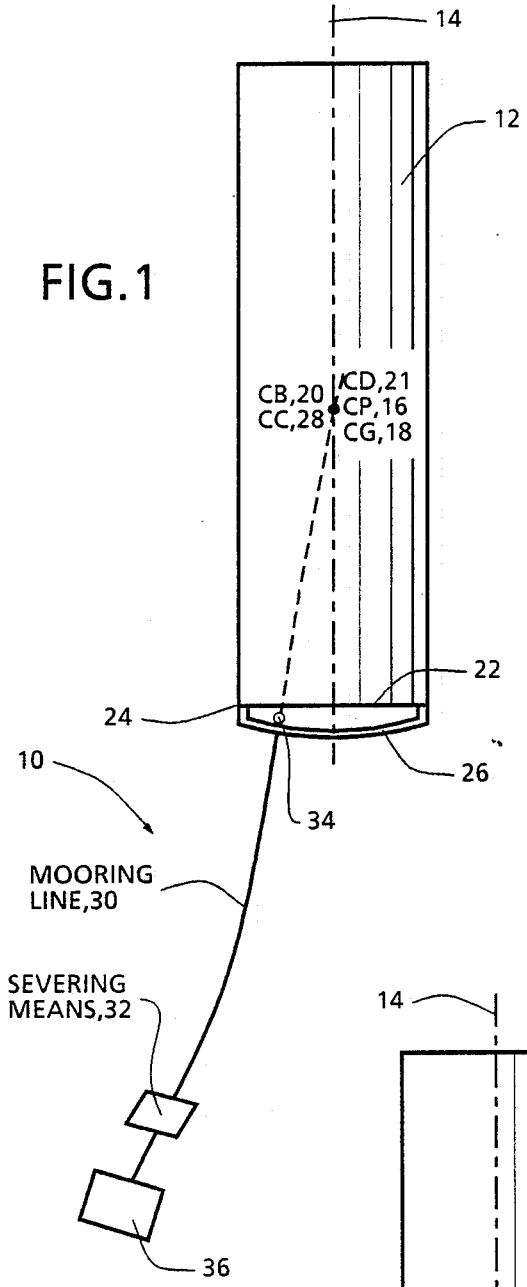
FIG.1
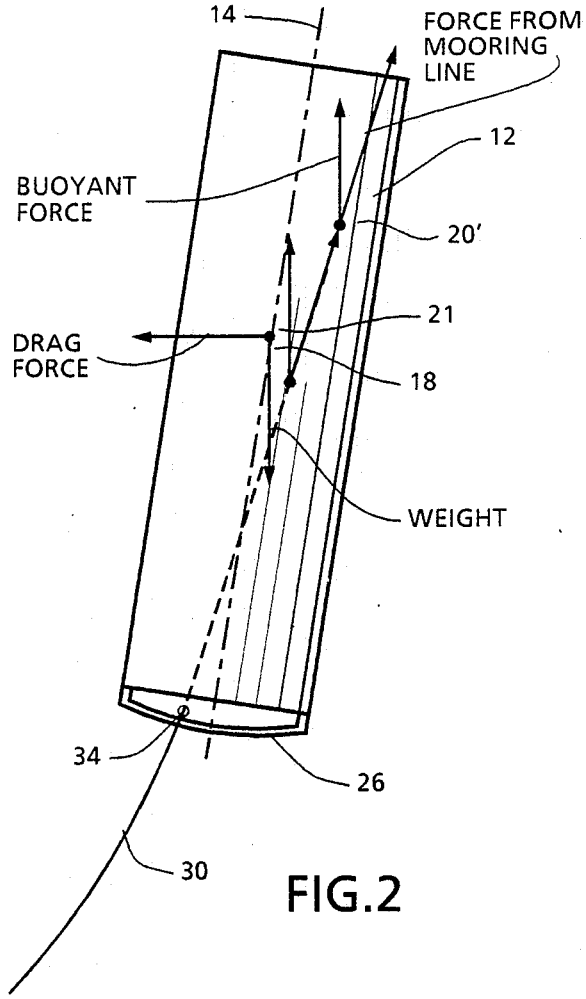
FIG.2
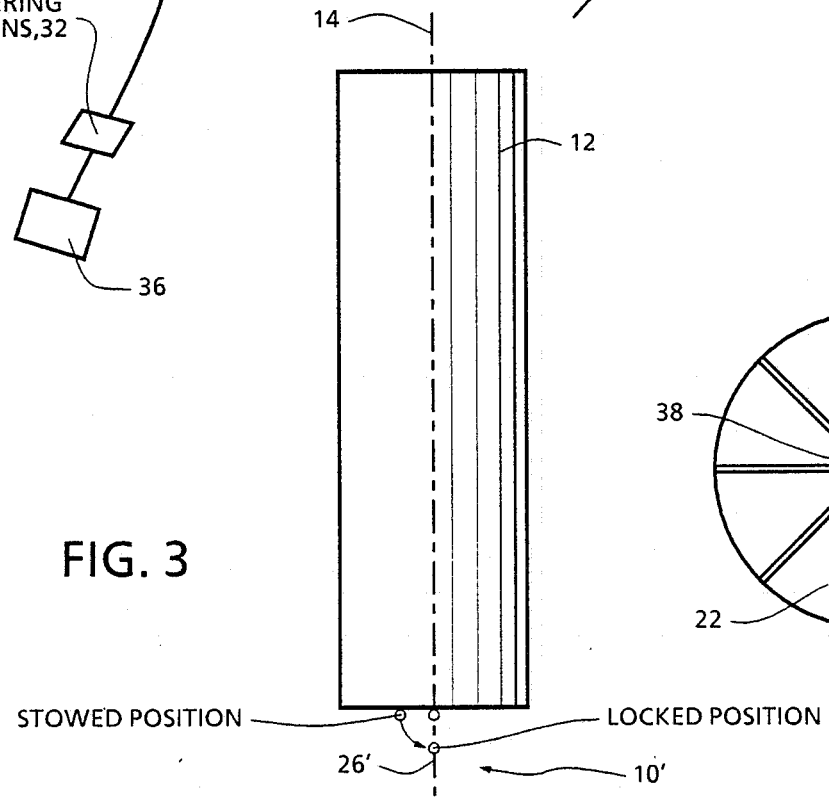
FIG. 3
FIG.4
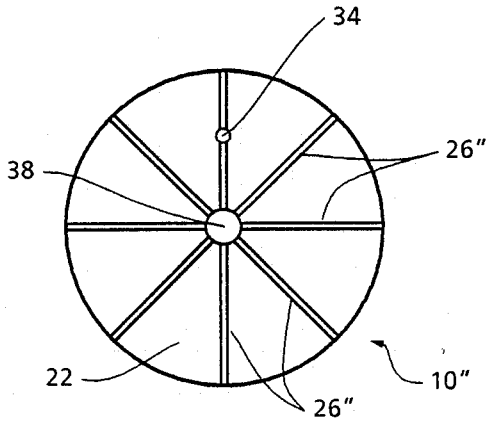

ANTI-TILT BUOY MOORING SYSTEM

BACKGROUND OF THE INVENTION

The present invention relates in general to buoys and more particularly to mooring systems for buoys.

The United States has used marine buoys equipped as mines as a weapon in every Naval war since the War of Independence. Marine buoy mines also proved a valuable asset in Southeast Asia. There is no reason to doubt that there will be continued, and even increased use of, marine buoy mines in any future encounter involving marine vehicles.

In addition to being used in naval warfare, marine buoys are being used in such diverse fields as oceanography, off-shore oil exploration, off-shore surveillance and docking systems. Use of buoys in these diverse fields as well as in marine mine applications is limited by many factors such as deployment, retrieval, cost, space limitations and corrosion.

Another important factor which may limit use of marine buoys is the actions of such buoys under the influence of wind and/or water currents. Such currents influence a buoy in several ways. First, the buoy may be forced out of position (as used in this application, a "stationary" buoy is a buoy that remains on-position after deployment). Second, the buoy may be upset out of the upright position. The first factor, that of maintaining a stationary buoy, is presently remedied by simply attaching an anchor to the buoy. However, devices and systems known to applicants do not remedy the second factor of providing a "stable" buoy while satisfying the other enumerated conditions such as cost, etc. It is this second factor of buoy stability to which the device of the present invention is directed. As used in this application, the term "stable" is defined to mean "non-tilting". Thus, a stable buoy is a buoy which remains essentially upright even though subjected to varying wind and/or water currents.

Marine buoy mooring devices and systems are as old as marine buoys themselves. Examples of mooring devices are: the bridles shown in Bogle, U.S. Pat. No. 2,487,786, Martin, U.S. Pat. No. 3,049,732, Bridges, U.S. Pat. No. 3,384,867 and Johnson, U.S. Pat. No. 3,378,863; the flexible systems shown in Roehler, U.S. Pat. No. 3,728,748; the links or rods shown in Lloyd, U.S. Pat. No. 3,077,614, Holmes, U.S. Pat. Nos. 3,487,484 and Feyling, 3,423,777, the ballast system shown in Jacobson, U.S. Pat. No. 3,307,208, the intermediate buoy system shown in Clark, U.S. Pat. No. 3,256,539; and the combination system shown in Dodge, U.S. Pat. No. 2,819,476.

While most devices and systems known to applicants serve the primary purpose of mooring a buoy in position, only a very few provide the stability required by modern buoys. Of these few systems, none satisfy the additional requirements of efficient deployment and reliable operation. In addition, all of the devices and systems suffer from the above-discussed space and cost limitations which have inhibited of marine buoys in fields such as oceanography.

Mooring systems using bridles are good examples of the drawbacks inherent in the mooring systems known to applicants. Bridles are difficult to store and deploy because the flexible bridle often becomes tangled and kinked during storage or loading. Furthermore, once deployed, bridles are often unacceptable if the buoy is to remain stationary when subjected to varying water and/ or wind currents. The flexible bridle allows the buoy to "wander" off-position, thus increasing the watch-circle carefully defined by the mooring line. Post-deployment tangling and kinking tendency of bridles is perhaps their most troublesome drawback. Permanent tilt may result from entangled bridle. Such a condition is totally unacceptable for a buoy which must remain upright.

Many mooring systems, such as those disclosed by Jacobson and Feyling, provide buoy stability by simply lowering buoy center of gravity. However such systems suffer two important disadvantages; first, they are difficult to deploy; and second, the buoy center of buoyancy is lowered along with the center of gravity, thus diluting some of the gains in buoy stability made by these systems.

The present invention overcomes these drawbacks by providing a marine buoy mooring system which provides a stable, easily deployed buoy which is inexpensively manufactured as well as conveniently stored.

SUMMARY OF THE INVENTION

Briefly, the device and system of the present invention is used in mooring a buoy and comprises a means for movably connecting a mooring line to a bail mounted on the bottom of the buoy. The mooring device is mounted on the buoy so that the bail center of curvature is essentially coincident with the buoy center of buoyancy.

With the bail center of curvature positioned at or near the buoy center of buoyancy, force from the mooring line is directed through the center of buoyancy. The mooring force thus directed produces a force couple which quickly and efficiently rights a tilted buoy. Advantages of the mooring system of the present invention include: simple manufacture and installation; low susceptability to kinking and tangling; easy storage; easy deployment and control after deployment. Furthermore, the simplicity of this mooring device and system makes it compatible with a large variety of known retrieval systems.

Alternative embodiments of the mooring system and device include a foldable bail to facilitate system storage and a system having a plurality of bails to compensate for twist of a buoy about its centerline.

Therefore it is apparent from the above brief description that a broad objective of the present invention is to moor a marine buoy in a stable or untilted position.

A further object of the present invention is to provide an easily deployable buoy mooring system.

Another object of the present invention is to provide a marine buoy mooring system which is conveniently stored.

Still another object of the present invention is to provide a marine buoy mooring system which allows easy retrieval of the buoy.

Yet another object of the present invention is to provide a reliable mooring system.

A further object of the present invention is to provide a buoy mooring system which compensates for the twisting of a buoy about its centerline.

Yet another object of the present invention is to provide a buoy mooring device which is easily manufactured and installed on a buoy.

BRIEF DESCRIPTION OF THE DRAWINGS

Other objects, features and a fuller understanding of the invention may be had by referring to the following description and claims, taken in conjunction with the accompanying drawing in which like components are denoted by prime notations and in which:

FIG. 1 shows the device of the present invention in conjunction with a marine buoy;

FIG. 2 shows the force vectors present in a buoy moored by the device of the present invention;

FIG. 3 shows a sideview of a buoy having an alternative embodiment of the device of the present invention wherein the bail is collapsible and FIG. 4 shows an alternative embodiment of the subject mooring device comprising a plurality of bails.

DESCRIPTION OF THE PREFERRED EMBODIMENTS

With reference to FIG. 1 the mooring system 10 of the present invention is illustrated as being utilized in conjunction with a submerged marine buoy 12. Located along the buoy centerline 14 at or near the buoy center of pressure (CP) 16 are the buoy center of gravity (CG) 18 and center of buoyancy (CB) 20. As used herein, "center of pressure" is the position of the point of application of the resultant force on a submerged surface and "center of buoyancy" is the position on buoy 12 where the buoyant force is assumed to act. As these terms are applied, buoy 12 may be any shape desired for the particular application. At or near the center of pressure is the center of drag 21.

Connected to buoy bottom 22 by means 24, such as welds, is bail 26 of mooring system 10. As used herein, a "bail" is a rigid half-hoop for supporting something, like the arched handle of a kettle, as opposed to a "bridle" which is a soft, pliable connection. Bail center of curvature (CC) 28 is positioned at or near buoy center of buoyancy 20. Mooring line 30, having thereon severing means 32, is movably connected at one end to bail 26 by movable connecting means such as roller 34!and at the other end attached to an anchor 36. Connecting means 24 are shown positioned at the outer periphery of buoy bottom 22, however the position of means 24 is controlled only by the requirement that the bail center of curvature be essentially coincident with the buoy center of buoyancy. Bail 26 may also be a T-beam track without departing from the spirit of this invention.

With reference to FIG. 2, as varying wind and/or water currents act to tilt the buoy 12 of the mooring system 10 out of the upright position shown in FIG. 1 into the tilted position shown in FIG. 2, roller 34 moves along bail 26 thus directing force from mooring line 30 through center of buoyancy 20'. Therefore, the essential coincidence of bail center of curvature 28 and buoy center of buoyancy is an important feature of the mooring system 10. If buoy 12 is completely submerged, stability demands only that buoy center of gravity 18 be below center of buoyancy 20' in the normal untilted configuration. The mooring system 10 serves to lower the center of gravity without affecting the position of the center of buoyancy. Therefore, because of the coincidence between bail center of curvature 28 and buoy center of buoyancy 20', the moment generated by buoy weight is the only moment about the center of buoyancy 20'. This is a "righting" moment tending to return buoy 12 to an upright position.

If the buoy 12 is a surface buoy, the only condition for stability is that buoy metacentric height be positive. Since mooring system 10 lowers the buoy center of gravity without affecting the position of the untipped center of buoyancy, mooring system 10 produces a positive metacentric height.

Bail 26 provides a rigid connection between mooring line 30 and buoy 12, thus there are no lines to become tangled because the only flexible system component is mooring line 30. An equally important advantage resulting from the rigid bail feature is buoy stability in heavy currents. In heavy currents, buoy 12 will tilt severely thus forcing roller 34 to a position adjacent one of the connections 24. The rigid bail allows buoy 12 to orient with current flow, thus reducing "wandering" of the buoy. A flexible connection between mooring line 30 and buoy 12 would allow the buoy to "wander" and oscillate with the current.

Preferably but not necessarily, anchor 36 is fixed into the sea bottem. Any current forces will cause the buoy 12 to "dip" since the buoy does not tilt, dip is merely the vertical movement of buoy 12.

Mooring line 30 is stored in anchor 36 and, upon deployment of the buoy-mooring system, plays out to the desired length. Because the system is compact, the entire buoy-mooring system can be stored and deployed conveniently.

Severing means 32 can also be stored in anchor 36. Therefore, upon deployment of mooring line 30, the severing means also can be deployed. The severing means is used in recovering the buoy. The recovery operation will be discussed below.

Shown in FIG. 3 is a hinged bail 26' of alternative mooring system 10'. Bail 26' is folded into a operating or locked position from the stowed position. This fold-out feature provides compactness to the system.

Some ambient conditions may cause buoy 12 to twist about centerline 14. Shown in FIG. 4 is a multiple-bail device of a mooring system 10'' which compensates for twisting of buoy 12. Attached to the buoy bottom 22 is a plurality of bails 26'' having thereon a transfer means 38. As buoy 12 tilts, movable connecting means 34 shifts on bails 26'' as above-discussed with reference to the preferred embodiment shown in FIG. 1. Under the influence of currents tending to twist buoy 14 about centerline by, a single bail system will twist to orient the bail with the current. The multiple-bail device shown in FIG. 4 will operate similarly until roller 34 reaches transfer means 38. When roller contacts transfer means 38, the roller is transferred to another bail thus maintaining mooring force in alignment with the current without unduly twisting buoy 12 or mooring line 30. The transfer means could be the intersection of a plurality of T-beamed tracks 26, discontinuous at 38, to allow the movable connecting means to roll and transfer between bails.

In operation, the buoy and its mooring system is launched in any convenient manner, such as from a torpedo tube of a submarine. Once deployed, the anchor 36 is released using any convenient means, thus playing-out mooring line 30 and the attached severing means 32. As above discussed once in position, the buoy will remain stationary as well as upright because the mooring line force is directed through the buoy center of buoyancy. Retrieval of the buoy is effected by activating severing device 32 to release buoy 12 from anchor 36. Buoy 12 floats to the surface and is easily retrieved. The operation of a buoy having a plurality of bails is similar to the operation of a buoy having a single bail.

Foldable bail 26' of mooring system 10' is unlocked in any convenient manner, such as by the force exerted by released anchor 36. Once bail 26' is moved into the unlocked position, operation of system 10' is similar to the operation of system 10.

Obviously, many modifications and variations of the present invention are possible in light of the above teachings. It is therefore to be understood that, within the scope of the appended claims, the invention may be practiced otherwise than as specifically described.

What is claimed as new and desired to be secured by Letters Patent of the U.S. is:

1. Means for attaching a buoy having a center of buoyancy to a mooring line comprising:

means for directing the force generated by said mooring line through the center of buoyancy of said buoy, said means comprising an arcuate bail rigidly attached to the bottom of said buoy with the center of curvature of said bail being essentially coincident with the center of buoyancy of said buoy, and movably mounted connecting means on said bail for connecting said bail to said mooring line.

2. The buoy attaching means of claim 1 wherein said bail is attached to the bottom of said buoy adjacent the outer periphery thereof.

3. The buoy attaching means of claim 1 wherein said bail is foldably attached to said buoy.

4. Means for attaching a buoy to a mooring line, comprising:

a plurality of bails attached to the bottom of said buoy, the center of curvature of said bails being essentially coincident with the center of buoyancy of said buoy; and movably mounted connecting means on said bails for connecting said bails to said mooring line.

5. The buoy mooring attachment means of claim 4 including a transfer means mounted on said bail to transfer said movably mounted connecting means from one bail to another.

6. A buoy mooring system adapted to maintain a buoy in an upright attitude comprising:

a buoy having a center of buoyancy;

a mooring line;

an anchor attached to one end of said mooring line, said mooring line being stored in said anchor;

an arcuate bail rigidly attached to said buoy with the center of curvature thereof being substantially coincident with the center of buoyancy of said buoy; and means movably mounted on said bail to connect to the other end of said mooring line to said bail, whereby the force generated by said mooring line is directed through the center of buoyancy of said buoy to thereby maintain said buoy in an upright attitude.

7. The buoy mooring system of claim 6 including means for severing said mooring line.

* * * * *